US006282765B1

(12) United States Patent
Schâpper et al.

(10) Patent No.: US 6,282,765 B1
(45) Date of Patent: Sep. 4, 2001

(54) METHOD AND DEVICE FOR ALIGNING EYELETS OF HARNESS ELEMENTS

(75) Inventors: Walter Schâpper, Buchs (CH); Markus Wolf, Schaan (LI)

(73) Assignee: Stäubli AG Pfäffikon, Pfäffikon (CH)

( * ) Notice: Subject to any disclaimer, the term of this patent is extended or adjusted under 35 U.S.C. 154(b) by 0 days.

(21) Appl. No.: 09/462,899

(22) PCT Filed: Jul. 10, 1998

(86) PCT No.: PCT/CH98/00303

§ 371 Date: Jun. 30, 2000

§ 102(e) Date: Jun. 30, 2000

(87) PCT Pub. No.: WO99/04077

PCT Pub. Date: Jan. 28, 1999

(30) Foreign Application Priority Data

Jul. 17, 1997 (CH) ..... 1754/97

(51) Int. Cl.[7] ..... D03J 1/14
(52) U.S. Cl. ..... 28/205
(58) Field of Search ..... 28/205, 207, 207.1, 28/206

(56) References Cited

U.S. PATENT DOCUMENTS

| | | | | |
|---|---|---|---|---|
| 2,828,527 | * | 4/1958 | Meierhofer | 28/205 |
| 4,038,729 | | 8/1977 | Townsend . | |
| 4,499,638 | * | 2/1985 | John et al. | 28/207 |
| 5,111,560 | * | 5/1992 | Sato | 28/204 |
| 5,826,315 | * | 10/1998 | Kuroyanagi | 28/206 |

FOREIGN PATENT DOCUMENTS

92/05303 4/1992 (WO) .

* cited by examiner

*Primary Examiner*—Andy Falik
(74) *Attorney, Agent, or Firm*—Venable; Gabor J. Kelemen

(57) ABSTRACT

A drawing-in machine includes a harness element provided with an eyelet; an arrangement for displacing the harness element in a direction parallel to the length dimension of the harness element; and a device for aligning the eyelet with a desired drawing-in position. The device includes a sensor detecting an actual position of the eyelet; and an arrangement for displacing the harness element from the detected actual position into the desired drawing-in position.

15 Claims, 3 Drawing Sheets

METHOD AND DEVICE FOR ALIGNING EYELETS OF HARNESS ELEMENTS

BACKGROUND OF THE INVENTION

The invention relates to a method and a device for aligning eyelets of harness elements for weaving machines.

Such devices and methods are known mainly for the centering of the eyelets of healds which are used in weaving machines. The centering of the eyelet is important when a thread is to be drawn in through the eyelet, since this takes place, for example, by means of drawing-in devices which shoot a drawing-in needle with a warp thread through the eyelet at high speed. If contact occurs between the eyelet and the drawing-in needle, the heald can be damaged, or the drawing-in operation can easily be disrupted. However, the drawing-in operation normally takes place outside the weaving machine.

From EP 0 500 848 it is known, on the one hand, to align such eyelets only laterally from the outside and, on the other hand, to adjust the longitudinal position or the height of the eyelet via eyes which are provided at the ends of such harness elements. These eyes serve the purpose of carrying or hooking in the harness elements, such as healds. This also means that, in the weaving machine, the harness elements are moved or driven in their longitudinal direction via such eyes. In the weaving machine, the eyes are therefore subjected to forces which can deform them and wear them away, this occurring more severely the more frequently the harness element is moved.

Since, however, the position of the eyelet is determined only indirectly via the position of the lateral limit or the inner edge of the eye, the position of the eyelet in the longitudinal direction nevertheless changes with the degree of wear of the eve In this case, repositioning by known means is not possible.

SUMMARY OF THE INVENTION

The invention, as it is characterized in the patent claims, accordingly achieves the object of providing a method and a device which permit the position of an eyelet in a harness element to be detected more accurately and, if necessary, corrected.

The above object and others are accomplished by the invention in that the position of the eyelet is in fact detected, and that the position is corrected as a result of the detected position of the eyelet, by the harness element being displaced in its longitudinal direction. In the process, the position of the eyelet transverse to its longitudinal direction is predefined from the outside by a guide for the harness element. The position of the eyelet, seen in the longitudinal direction of the harness element, can be detected or sensed optically or mechanically. The correction is triggered by discrete signals. In the case of the device according to the invention, a sensor, which can be connected in and passes through the plane of the eyelet, is provided. The sensor can be designed as a mandrel, which is arranged on a carriage so that it can move transversely with respect to the eyelet, or as a light barrier, which is arranged transversely with respect to the eyelet and is designed so that it can be connected in. Furthermore, the sensor is assigned a mechanical guide, which can be connected in, for the harness element and a device for displacing the harness element in its longitudinal direction.

The advantages which are achieved by means of the invention are to be seen in the fact that, in general, healds or harness elements which are in a poor condition can thus be detected. This can even be done when there is no large-scale damage but just an eye with a cross-section widened as a result of wear. Hence, such harness elements can be separated out at an early stage and outside the weaving machine, which avoids interruptions in operation. Since, then, the drawing-in device no longer has any contact with the eyelets of the harness elements, it is not adversely affected either.

BRIEF DESCRIPTION OF THE DRAWING

In the following text, the invention is explained in more detail using explanatory examples, although these do not restrict the scope of protection in any way, and with reference to the appended figures, in which.

DESCRIPTION OF THE PREFERRED EMBODIMENTS

Figure 1:
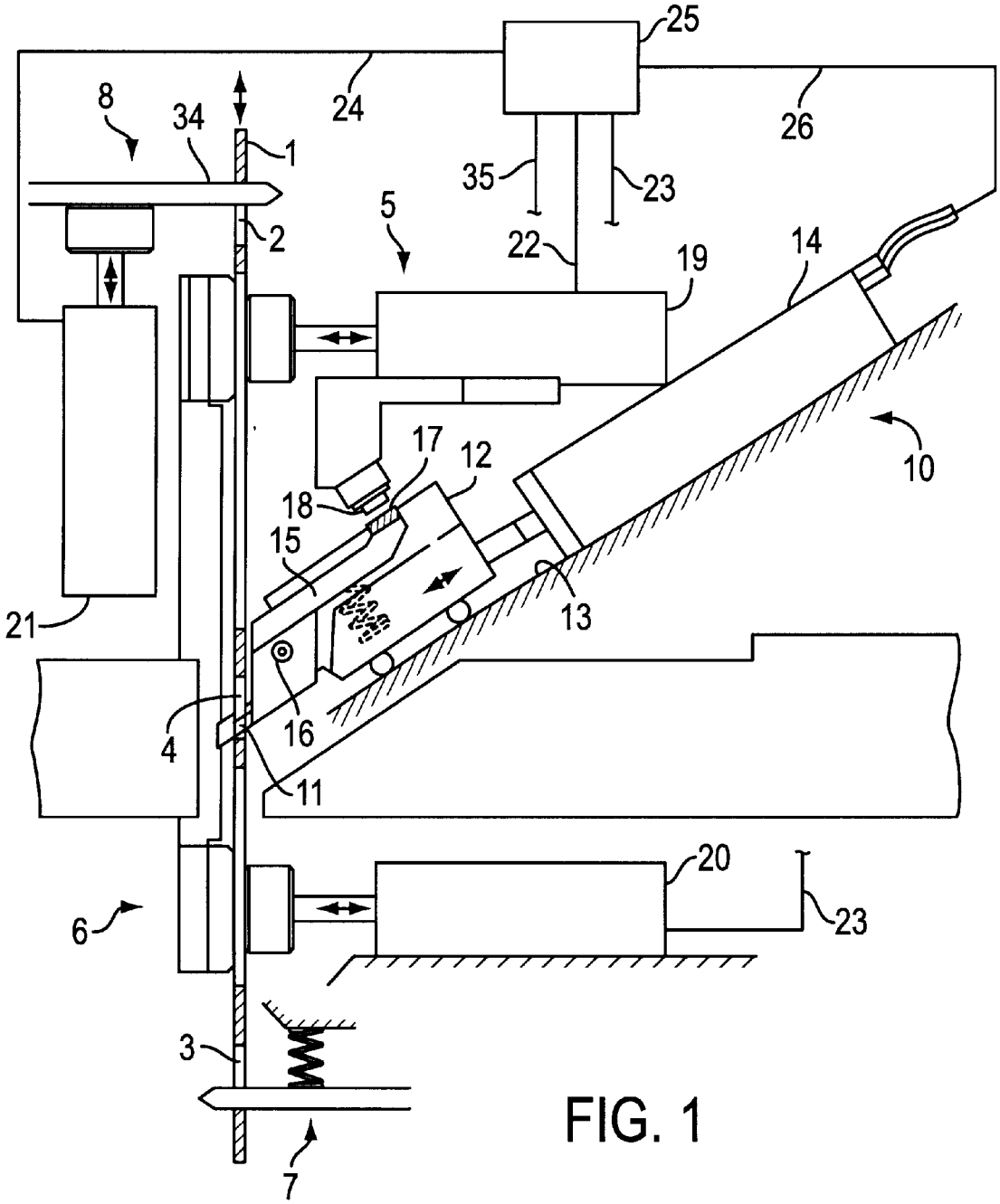
FIG. 1 shows a view of an inventive device according to a first embodiment, with mechanical detection of the position of the eyelet.

FIG. 1 shows—in a view of an inventive device according to a first embodiment, with mechanical detection of the position of the eyelet—as the harness element here a heald 1, partly sectioned and viewed from the side, with eyes 2, 3 and an eyelet 4. The heald is located in the drawing-in position in a drawing-in device such as is disclosed, for example, by EP 0 500 848. Two clamping devices 5, 6 and two tensioning devices 7, 8 for displacing the harness element in its longitudinal direction as indicated by the double-headed arrow A are arranged along the heald 1, the clamping devices 5, 6 clamping or fastening the heald 1 after it has been positioned by the tensioning devices 7, 8, which engage in the eyes 2, 3. All the elements listed above are known per se. In addition, a centering device 10 having a sensor 11 is arranged alongside the heald 1, the sensor being fastened to a carriage 12, which is mounted in such a way that it can be moved on an inclined plane 13 by a drive 14. The sensor is designed as a mandrel here and is fas ned on a rocker 15, which is mounted so that it can rotate about an axis 16. The rocker 15 has a contact point 17 for a switch 18, which is mounted in a fixed location.

The clamping devices 5, 6 and the tensioning device 8 each have a drive 19, 20, 21, which are connected to a control unit 25 via lines 22, 23, 24. The drive 14 is centering also connected to the control unit 25 via a line 26.

Figure 2:
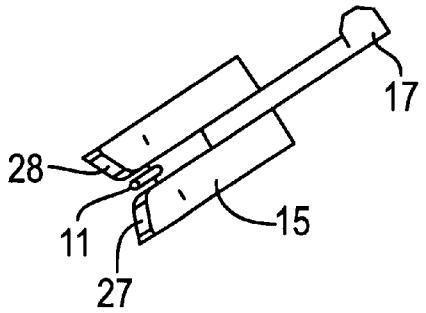
FIG. 2 shows part of an inventive device corresponding to FIG. 1.

FIG. 2 shows a plan view of the rocker 15 as part of an inventive device corresponding to FIG. 1, with the contact point 17, the sensor 11, which is designed as a mandrel here, and a lateral guide 27, 28, which can be seen better here, for the heald. The size relationships shown here reveal that the healds are intended to be of very narrow design in the region of the eyelet in this case.

Figure 3:
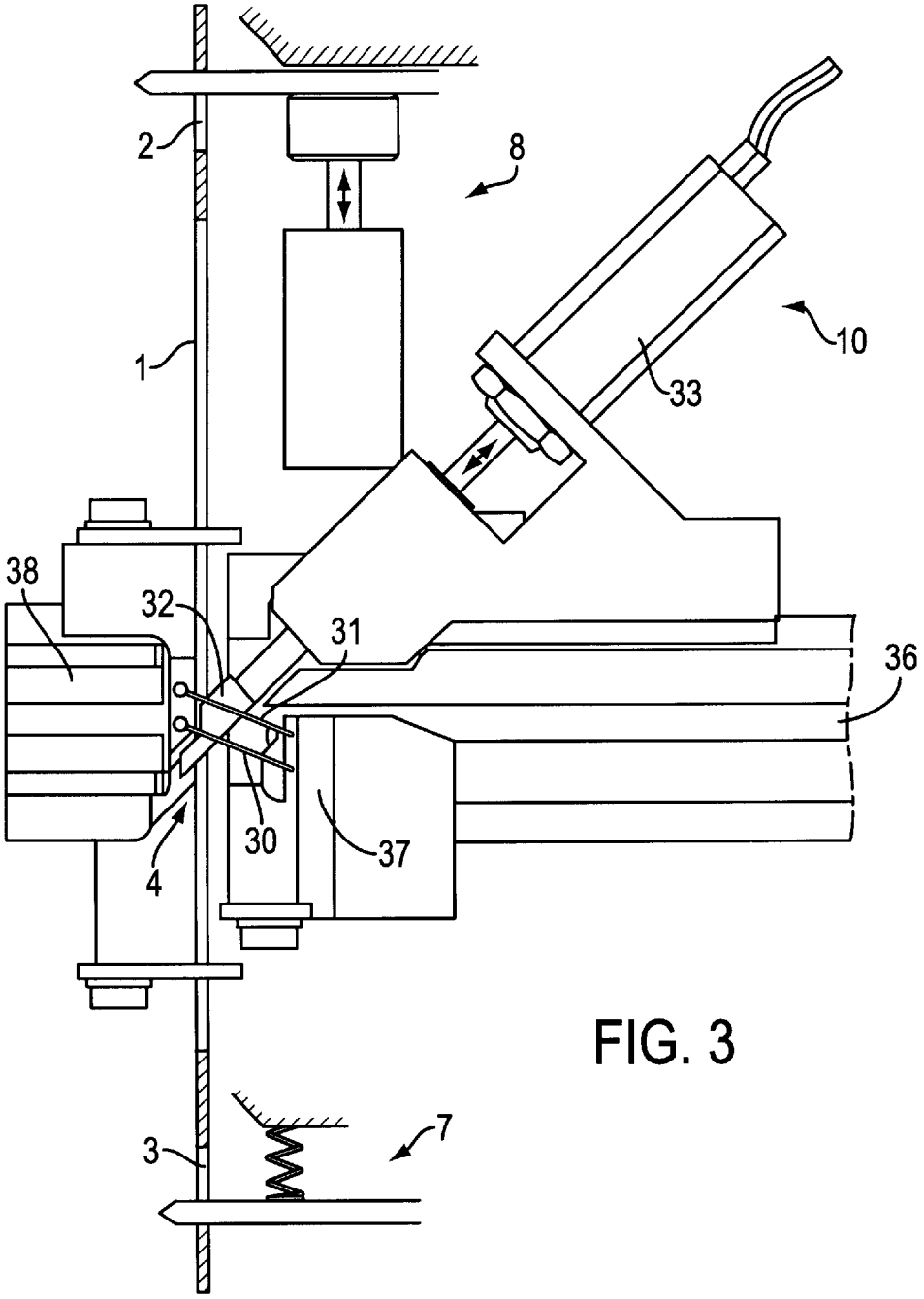
FIG. 3 shows a view of an inventive device according to a second embodiment, with optical detection of the position of the eyelet.

FIG. 3 shows a view of an inventive device according to a second embodiment, with optical detection of the position of the eyelet. In addition to the heald 1 with eyes 2, 3 and the eyelet 4, it is likewise possible to see the known tensioning devices 7, 8. The sensor provided here comprises two light barriers 30, 31, which are illustrated here essentially by the emitted beams, which each originate, in a manner known per se, from a source 37 and are picked up by a receiver 38. In addition, a mechanical, lateral, fork-like guide 32, which can be connected in, is provided, since the sensor does not exert any forces on the heald 1.

Figure 4:
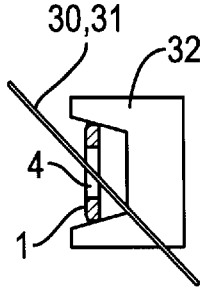
FIG. 4 shows part of an inventive device corresponding to FIG. 3.

FIG. 4 shows part of an inventive device corresponding to FIG. 3, with the guide 32 with the heald 1 and the beams of the light barriers 30, 31 in a view which, by comparison with the view in FIG. 3, is rotated through 90°. It can be seen here that the guide 32 is intended for eyelets or healds that are significantly wider. It is clear that the guide 32 that is shown can also be provided in the design according to FIG. 1, with mechanical sensing of the eyelet, and vice versa.

Figure 5A:
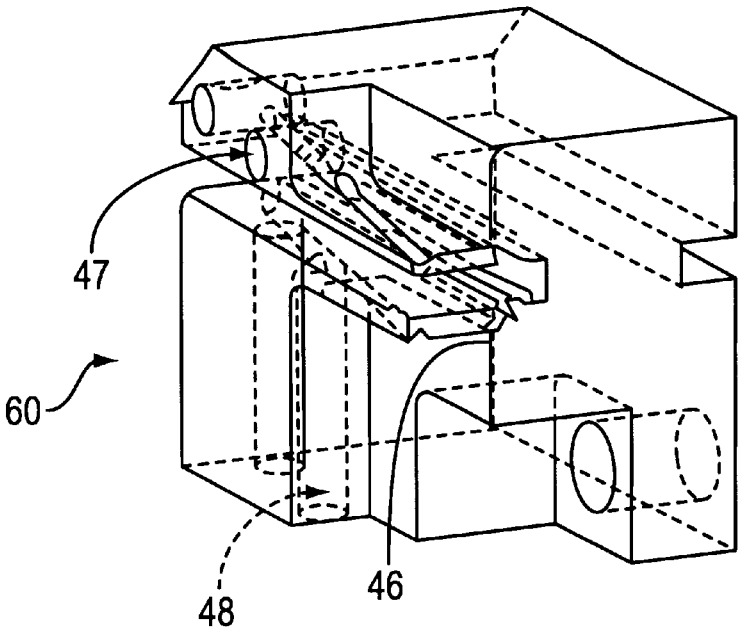
FIGS. 5*a, b* show two three-dimensional views of an integral part according to a preferred variant of the second embodiment.
Figure 5B:
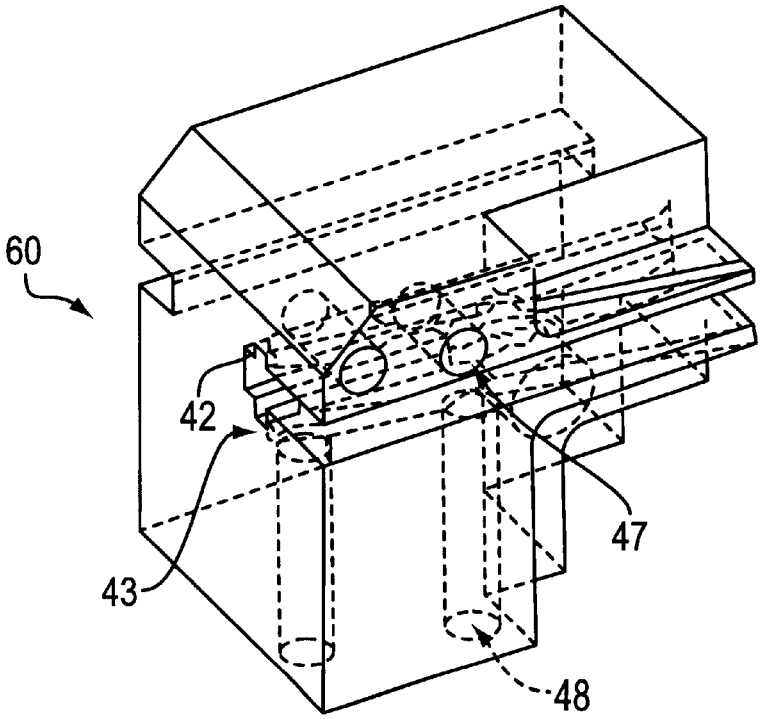

FIGS. 5*a, b* show two three-dimensional views of an integral part 60 according to a preferred variant of a second embodiment. Whereas the sensors in FIGS. 3 and 4 are designed as light barriers, optical fibres 40, 41 have been selected here (not illustrated). Like the sensors 30, 31 in the first variant, illustrated in FIGS. 3 and 4, the sensors 40, 41 are arranged in two mutually parallel planes here, as can be seen from the illustration of the drilled holes 42 and 43 which accommodate these optical fibres 40, 41. These two optical fibres are connected to a common light source or to two individual light sources 50 (not shown) and pass on the light emitted by this light source or by these light sources. The light source 50 may comprise laser diodes, incandescent lamps and other electric components that produce light, and does not necessarily need to be arranged in the same plane as the optical fibres. Whereas the light barriers 30, 31 are preferably arranged in two inclined planes that run parallel to each other (FIG. 3), the optical fibres 40, 41—at least in the region that defines the direction of the emitted light beam or bundle of light—extend in two horizontal planes that run parallel to each other.

The mode of operation of the invention is as follows: The healds 1 or harness elements are fed on devices such as are known, for example, from EP 0 500 848. Such devices are, for example, part of a drawing-in device and have holding means 34, which are arranged to circulate and move the harness element into a drawing-in position in a manner known per se. This drawing-in position is also illustrated in FIGS. 1 and 3 for the heald 1. Once the drawing-in position has been reached, the heald 1 is tensioned by the holding means 34 being lifted by means of the tensioning device 8 counter to the spring force of the tensioning device 7, and is firmly clamped by the clamping devices 5, 6, which is brought about the control unit 25, to which the entry of the heald 1 has been reported by suitable sensors. Via the line 26, the drive 14 is set in motion, with the result that the carriage 12, together with the rocker 15, the guides 27, 28 and the mandrel or sensor 11, aligns the eyelet 4 from the outside and from the inside. In the process, the sensor passes through the plane of the eyelet (here, perpendicular to the drawing plane), and the mandrel 11 is finally located above the lower edge of the eyelet 4. Via the line 24, the control unit 25 outputs a signal which activates the drive 21 in such a way that the holding means 34 is displaced further upwards, in the longitudinal direction of the heald 1. In the process, the lower edge of the eyelet 4 strikes against the mandrel 11 and moves the latter upwards, which is possible because of the mounting of the latter, and the mounting of the rocker 15, about the axis of rotation 16. As a result, the contact point 17 moves away from the switch 18, so that the latter reports this to the control unit 25 via a line 35. However, the upward movement of the heald 1 is limited by the tilted rocker 15. If the mandrel 11 does not strike against the lower edge of the eyelet 4, there is no corresponding signal either, which means that the heald 1 is excessively worn, that is to say is damaged. If, however, the above-described signal is output by the switch 17, then the clamping devices 5, 6, which have previously been loosened, can be tightened against, and the carriage 12 can be moved back by the drive 14. The eyelet is then precisely aligned, and the drawing-in operation can be carried out. Thus far, the centering of the eyelet 4 as it is carried out using the device according to FIG. 1.

Centring using the device according to FIG. 3 has several steps, which proceed in precisely the same way as those described above. The difference is that, as the guide 32 is moved out, no mechanical sensor is moved directly into the eyelet 4. Connected in as sensors are the light barriers 30, 31, which illuminate transversely through the eyelet 4 when the guide 32 is moved out and centers the heald 1 on the outside. The two light barriers 30, 31 test the position of the eyelet 4 in terms of the height or longitudinal direction of the heald 1. If both beams from the two light barriers 30, 31 are present, that is to say are not interrupted, then the position of the heald is good and the drawing-in operation can begin. If only the upper beam from the upper light barrier 31 is present, the position of the heald 1 is wrong and must be readjusted, in that the heald is lowered by the tensioning device 8. If only the lower beam from the light barrier 30 is present, then the eye 2 of the heald 1 has widened upwards, and the eyelet 4 must be pulled upwards with the heald 1, which again is performed by the tensioning device 8. If both the signals or beams from the two light barriers 30, 31 are present again, then the position of the eyelet is good and a thread can be drawn in. At this time, the guide 32 can remain in the moved-out position. After a thread has been drawn in through the eyelet 4, said guide 32 is moved back. The control unit 25, which is also present here, receives signals for this from the receiver 38, these signals specifying which light beam is present.

It is true for both the designs that the control unit 25 is activated by discrete signals, which simply consist in that a signal is present or not, as applies to the switch 17 or light barriers 30, 31.

The integral part 60 combines the centering of the drawing-in hook and the detection of the position of the thread eyelet in one part, preferably in a component that can be produced in one piece. This has, inter alia, the following advantages:

- The design tolerance chains of the design according to the first variant are eliminated, and as a result the optical fibres find the optimum position of the drawing-in hook.
- Because the integral part 60 forms the basis for centering the thread eyelet, it is possible for the defined position of the optical fibres 40, 41 to be ensured by the drawing-in channel 46, for example by means of simple stiffening 47, 48 (cf. 36 in FIG. 3).
- The use of optical fibre transmitters, which emit a light cone of about 30°, and of optical fibre receivers, which receive just those signals which correspond to the actual optical fibre diameter, has the effect that the offset of the side having the optical fibre transmitter with respect to the side having the optical fibre receiver becomes irrelevant, since the finding or the detection of the thread eyelet has to be accurate only from the reed side or optical fibre receiver side.

The adjustments of the light barriers according to the first variant, which require comprehensive knowledge of the mechanism, are dispensed with.

The optical fibres can be installed or exchanged without setting or adjustment operations.

What is claimed is:

1. A method of aligning an eyelet of a weaving harness element in a drawing-in machine with a desired drawing-in position; said weaving harness element having a length dimension; the method comprising the following steps:

(a) detecting an actual position of the eyelet; and (b) based on the detected actual position, displacing said harness element in a direction parallel to said length dimension for placing said harness element into the desired drawing-in position.

2. The method as defined in claim 1, further comprising the step of pre-defining by a guide a position of the eyelet transversely to said length dimension.

3. The method as defined in claim 1, wherein said detecting step comprises the step of optically detecting the actual position of the eyelet.

4. The method as defined in claim 1, wherein said detecting step comprises the step of mechanically detecting the actual position of the eyelet.

5. The method as defined in claim 1, further comprising the step of triggering said displacing step by discrete signals.

6. A drawing-in machine comprising (a) a harness element having a length dimension and being provided with an eyelet;

(b) means for displacing said harness element in a direction parallel to said length dimension; and (c) a device for aligning said eyelet with a desired drawing-in position; said device including (1) a sensor detecting an actual position of the eyelet; and (2) means for displacing said harness element from the detected actual position into the desired drawing-in position.

7. The drawing-in machine as defined in claim 7, wherein said sensor comprises a light source, and further wherein said eyelet has a plane through which light from said light source passes.

8. The drawing-in machine as defined in claim 6, wherein said sensor comprises two light barriers arranged transversely with respect to said eyelet; further comprising means for placing said light barriers in an operative position.

9. The drawing-in machine as defined in claim 6, wherein said sensor comprises two optical fibers arranged transversely with respect to said eyelet; further comprising means for placing said optical fibers in an operative position.

10. The drawing-in machine as defined in claim 9, wherein said optical fibers are disposed in two mutually parallel, inclined planes.

11. The drawing-in machine as defined in claim 9, wherein said optical fibers are disposed in two mutually parallel, horizontal planes.

12. The drawing-in machine as defined in claim 6, further comprising a guide associated with said sensor and arranged for positioning said harness element.

13. The drawing-in machine as defined in claim 6, wherein said sensor includes a carriage movable transversely toward and away from said eyelet and a mandrel mounted on said carriage for introduction into said eyelet.

14. The drawing-in machine as defined in claim 6, further comprising a control unit; said sensor and said means for displacing said harness element being connected to said control unit for displacing said harness element as a function of signals received by said control unit from said sensor.

15. The drawing-in machine as defined in claim 7, further comprising an integral part combining a centering of a drawing-in hook and a detection of a position of said eyelet.

* * * * *